US008579732B1

(12) United States Patent
Hershkovich et al.

(10) Patent No.: US 8,579,732 B1
(45) Date of Patent: Nov. 12, 2013

(54) JUMPING GAME ASSEMBLY

(76) Inventors: Samuel Hershkovich, Brooklyn, NY (US); Heidi Hershkovich, Brooklyn, NY (US)

( * ) Notice: Subject to any disclaimer, the term of this patent is extended or adjusted under 35 U.S.C. 154(b) by 0 days.

(21) Appl. No.: 13/463,035

(22) Filed: May 3, 2012

(51) Int. Cl.
*A63B 67/00* (2006.01)

(52) U.S. Cl.
USPC ..... 473/414

(58) Field of Classification Search
USPC ..... 473/414, 589; D21/334, 365; 273/153 R, 157 R
See application file for complete search history.

(56) References Cited

U.S. PATENT DOCUMENTS

| | | | | | |
|---|---|---|---|---|---|
| D163,957 | S | | 7/1951 | Meyer | |
| D168,719 | S | | 1/1953 | Thomas | |
| 3,091,454 | A | | 5/1963 | Sam | |
| 3,107,095 | A | * | 10/1963 | Cairns | 473/414 |
| 3,136,545 | A | * | 6/1964 | Stokes | 473/414 |
| 3,139,281 | A | | 6/1964 | Nicholson | |
| 3,515,385 | A | * | 6/1970 | Gunderson | 473/414 |
| 3,768,809 | A | * | 10/1973 | Ciarfello | 473/414 |
| 4,176,471 | A | * | 12/1979 | Roe | 434/255 |
| 4,513,964 | A | * | 4/1985 | Gunderson | 273/126 R |
| 4,733,864 | A | * | 3/1988 | Casteel | 473/414 |
| 5,156,409 | A | * | 10/1992 | Barnes | 273/444 |
| D367,680 | S | | 3/1996 | Abbott | |
| 5,683,314 | A | * | 11/1997 | Musso | 473/414 |
| 5,785,613 | A | * | 7/1998 | Francis | 473/414 |
| 6,620,063 | B1 | | 9/2003 | Benjamin | |
| 7,481,726 | B2 | * | 1/2009 | Hawk | 473/414 |
| D638,069 | S | * | 5/2011 | Rodriguez | D21/365 |
| 2009/0075762 | A1 | | 3/2009 | De Palma | |
| 2010/0052253 | A1 | | 3/2010 | Macura et al. | |
| 2010/0199427 | A1 | * | 8/2010 | Anderson | 5/420 |

* cited by examiner

*Primary Examiner* — Mitra Aryanpour

(57) ABSTRACT

A jumping game assembly includes a mat having a plurality of panels. Each of the panels forms a target area configured for being jumped upon by a user. The panels are arranged into rows and columns defining adjacently positioned interior edges of the panels and outer edges of the panels. The outer edges correspond to an outer perimeter of the mat. A plurality of interior strips is coupled to and extends between the adjacently positioned interior edges of the panels. An upper border is coupled to and extends around the outer edges of the panels. A disc is configured for throwing onto the mat to distinguish one of the panels on which the disc lands as a jumping target for a game played by jumping on the mat in accordance with a set of rules.

6 Claims, 3 Drawing Sheets

JUMPING GAME ASSEMBLY

BACKGROUND OF THE INVENTION

Field of the Disclosure

The disclosure relates to jumping game devices and more particularly pertains to a new jumping game device for providing a stable jumping surface divided into distinct target areas to facilitate playing of a jumping game.

SUMMARY OF THE DISCLOSURE

An embodiment of the disclosure meets the needs presented above by generally comprising a mat including a plurality of panels. Each of the panels forms a target area configured for being jumped upon by a user. The panels are arranged into rows and columns defining adjacently positioned interior edges of the panels and outer edges of the panels. The outer edges correspond to an outer perimeter of the mat. A plurality of interior strips is coupled to and extends between the adjacently positioned interior edges of the panels. An upper border is coupled to and extends around the outer edges of the panels. A disc is configured for throwing onto the mat to distinguish one of the panels on which the disc lands establishing a jumping target for a game played by jumping on the mat in accordance with a set of rules.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
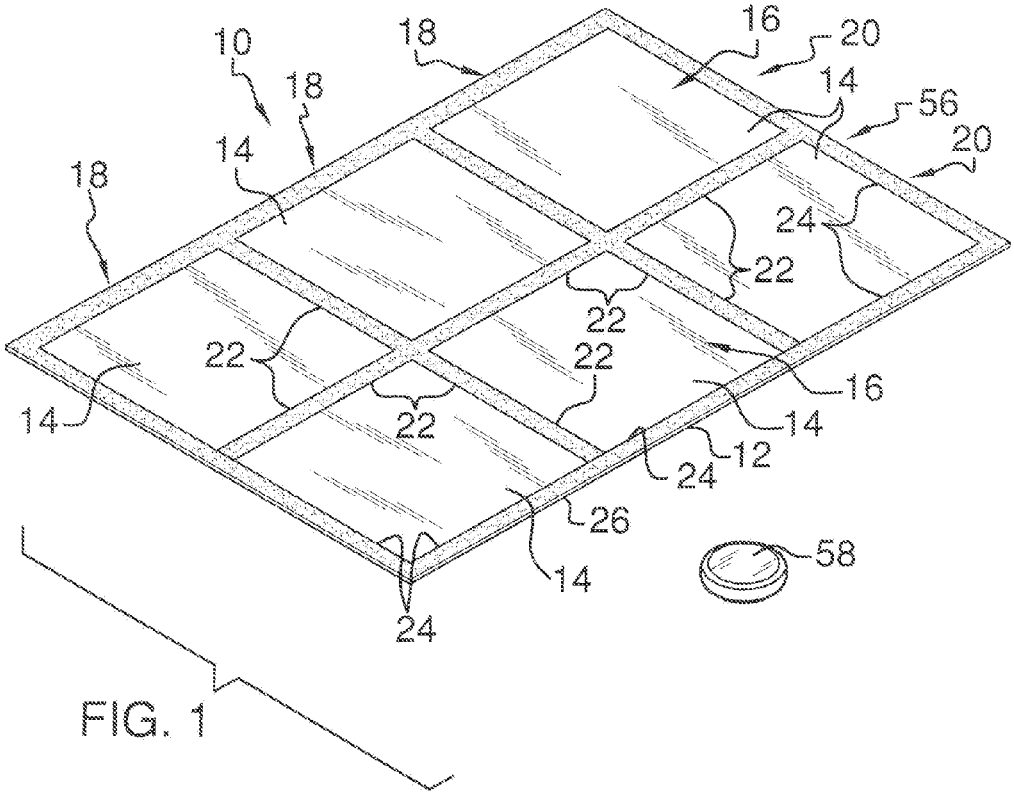
FIG. 1 is a top front side perspective view of a jumping game assembly according to an embodiment of the disclosure.
Figure 2:
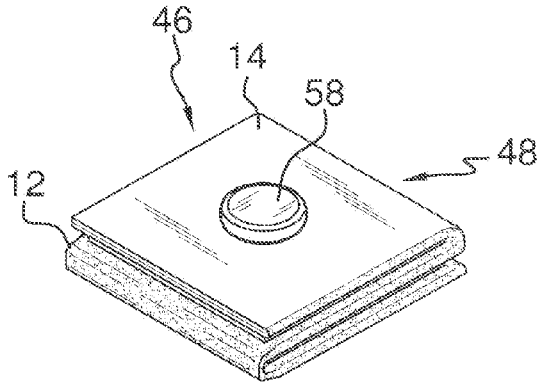
FIG. 2 is a top front side perspective view of an embodiment of the disclosure in a storage position.
Figure 3:
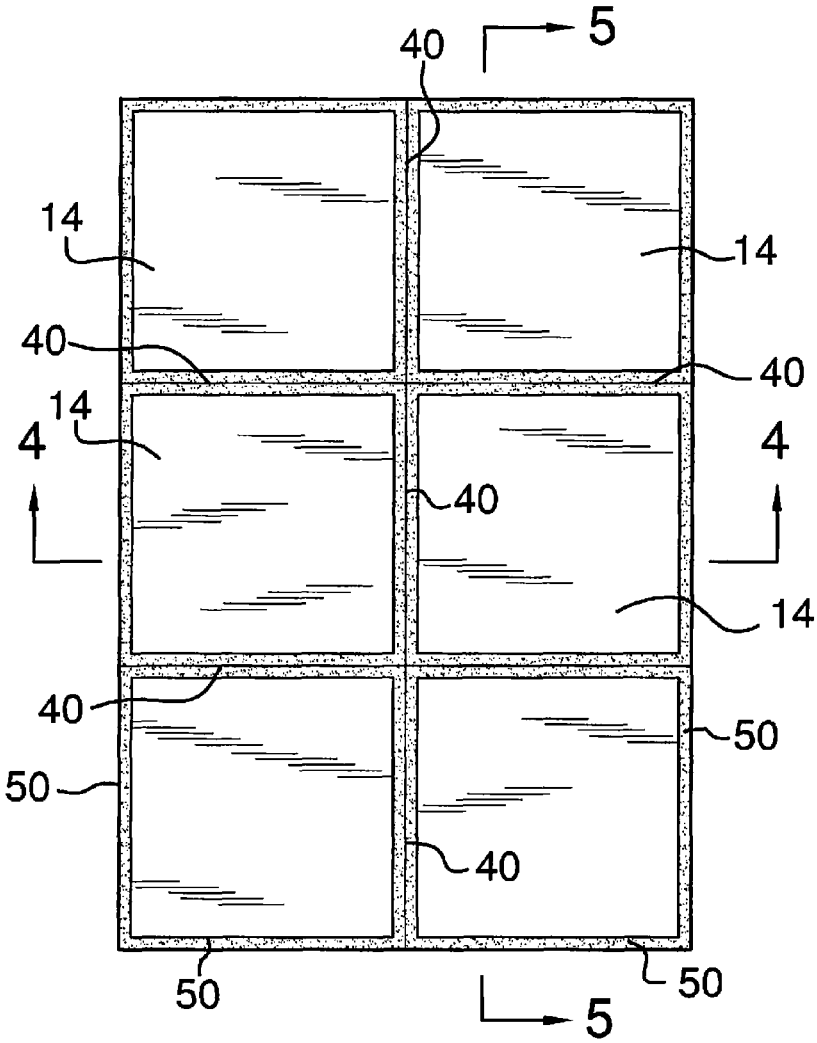
FIG. 3 is a top view of an embodiment of the disclosure.
Figure 4:
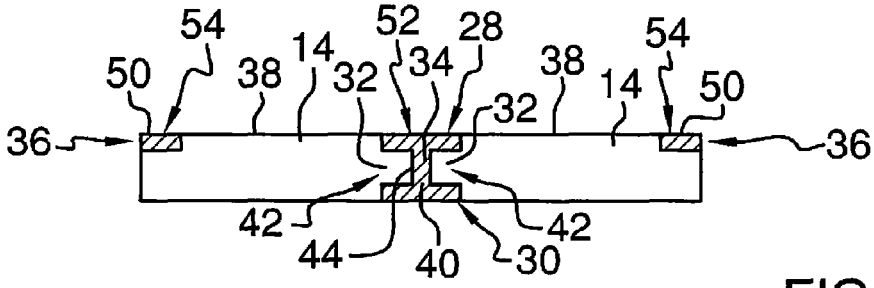
FIG. 4 is a cross-sectional view of an embodiment of the disclosure taken along line 4-4 of FIG. 3.
Figure 5:
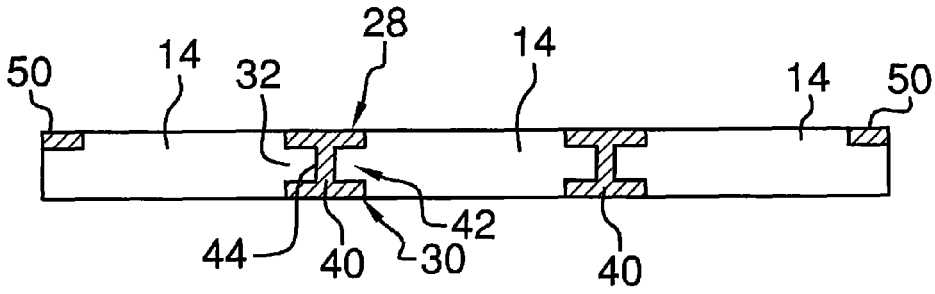
FIG. 5 is a cross-sectional view of an embodiment of the disclosure taken along line 5-5 of FIG. 3.
Figure 6:
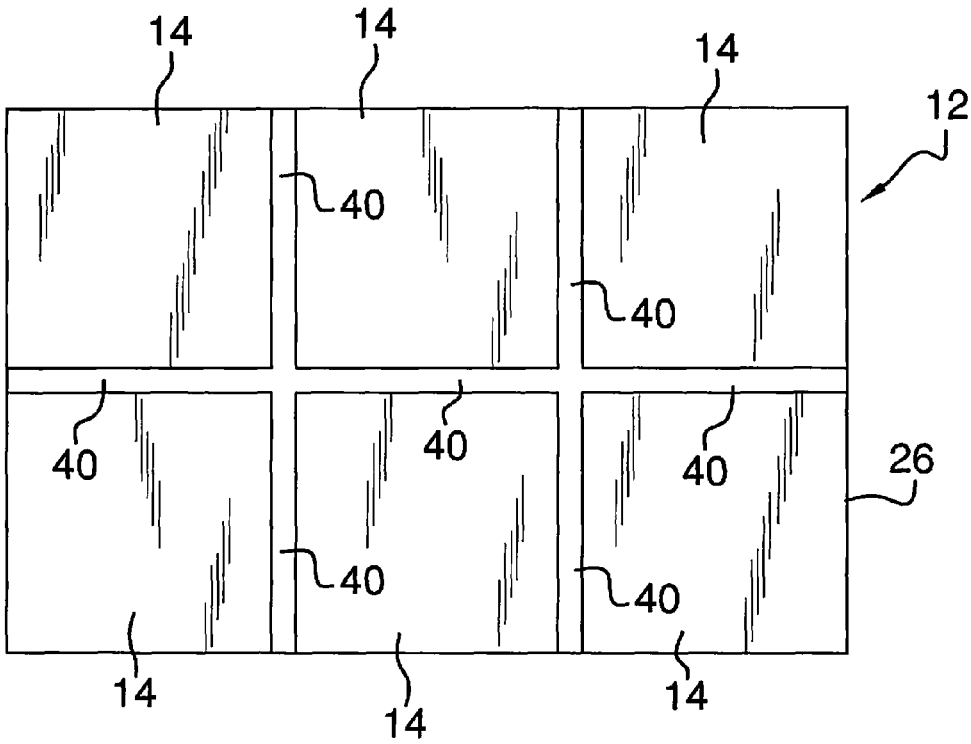
FIG. 6 is a bottom view of an embodiment of the disclosure.

With reference now to the drawings, and in particular to FIGS. 1 through 6 thereof, a new jumping game device embodying the principles and concepts of an embodiment of the disclosure and generally designated by the reference numeral 10 will be described.

As best illustrated in FIGS. 1 through 6, the jumping game assembly 10 generally comprises a mat 12 including a plurality of panels 14. Each of the panels 14 may be constructed of plastic. For purposes of playing a game, each of the panels 14 forms a target area 16 configured for being jumped upon by a user. The panels 14 are arranged into rows 18 and columns 20. There may be two columns 20 and three rows 18. The rows 18 and columns 20 define adjacently positioned interior edges 22 of the panels 14 and outer edges 24 of the panels 14. The outer edges 24 correspond to an outer perimeter 26 of the mat 12. The panels 14 may have aligned upper cutouts 28 and lower cutouts 30 extending along the interior edges 22 of the panels 14 defining a tongue 32 extending from a medial portion 34 of each interior edge 22 of the panels 14. The panels 14 may also have top cutouts 36 extending around the outer edges 24 of each of the panels 14. The upper cutouts 28 and top cutouts 36 may be joined such that the upper cutouts 28 and top cutouts 36 extend fully around a top surface 38 of each panel 14.

The panels 14 are joined together by a plurality of interior strips 40 coupled to and extending between the adjacently positioned interior edges 22 of the panels 14. Each of the interior strips 40 may be constructed of rubber. Each interior strip 40 has a medial groove 42 receiving the tongue 32 of an associated one of the interior edges 22 of the panels 14. Thus, the panels 14 are coupled to the interior strips 22. Each of the interior strips 40 has a flexible middle section 44 whereby the mat 12 is foldable such that the panels 14 are aligned into a stack 46 defining a compact storage position 48. A top surface 52 of each interior strip 40 is coplanar with the top surface 38 of each panel 14 when the mat 12 is in a deployed position 56.

An upper border 50 may also be coupled to and extend around the outer edges 24 of the panels 14. The upper border 50 may be constructed of rubber. The upper border 50 is coupled to and positioned in the top cutouts 36 extending fully around the mat 12. A top surface 54 of the upper border 50 may be coplanar with the top surface 38 of each panel 14 when the mat 12 is in the deployed position 56.

A disc 58 is provided for playing the game. The disc 58 may be constructed of plastic to facilitate sliding on the panels 14. The disc 58 is configured for throwing onto the mat 12 to distinguish one of the panels 14 upon which the disc 58 lands. The distinguished panel 14 may then be treated by the user in accordance with game rules described below.

Each panel 14 may have a unique color relative to each other panel 14. Each panel may form a square, each side having a length between 38 and 44 centimeters. Each upper cutout 28, lower cutout 30 and top cutout 36 may have a width between 0.75 and 1.75 centimeters. Each interior strip 22 may have a total width between 2.5 and 35 centimeters. The upper border 50 has a width consistent with the width of the top cutouts 36. The thickness of each panel 14 may be between 4 and 6 millimeters. The tongue 32 may have a thickness between 2.5 and 3.5 millimeters.

In use, the mat 12 and disc 58 may be used in accordance with rules of a game as follows. The game is played in turns. A player takes a turn by first throwing the disc 58 onto the mat 12 on a first one of the panels 14. The player then hops to the first one of the panels 14 on one leg. Jumping with both legs is permissible for younger children playing the game. The disc 58 is moved to a second one of the panels 14 by kicking the disc 58 using the same leg the player is hopping on. The player then moves to the second one of the panels 14 and play continues on moving the disc 58 through all of the panels 14. A turn is ended by a player missing the target to which they are throwing the disc 58, the disc 58 landing in a position touching the upper border 50 or interior strips 22, the player stepping on the upper border 50 or the interior strips 22, or the player losing their balance. Completion of the turn may result in a score or prize for the player such as a sticker, money, play money, or the like which may then be compared with other players at the end of the game to determine a winner. Variations may be made in combination with or in the alternative including throwing the disc 58 to a different one of the panels 14 during or starting successive turns or hopping over a panel 14 on which the disc 58 lays.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A jumping game assembly comprising:

a mat including;

a plurality of panels, each of said panels forming a target area configured for being jumped upon by a user, said panels being arranged into rows and columns, said rows and columns defining adjacently positioned interior edges of said panels and outer edges of said panels, said outer edges corresponding to an outer perimeter of said mat, a plurality of interior strips coupled to and extending between said adjacently positioned interior edges of said panels, said panels being constructed of plastic, and an upper border coupled to and extending around said outer edges of said panels, said upper border being constructed of rubber; and a disc, said disc being configured for throwing onto said mat to distinguish one of said panels on which said disc lands.

2. The assembly of claim 1, further comprising:

upper and lower cutouts extending along said interior edges of said panels defining a tongue extending from a medial portion of each interior edge of said panels; and each said interior strip having a medial groove receiving said tongue of an associated one of said interior panels whereby said panels are coupled to said interior strips.

3. The assembly of claim 1, further comprising:

top cutouts extending around said outer edges of each of said panels; and said upper border being coupled to and positioned in said top cutouts.

4. The assembly of claim 1, further including each of said interior strips having a flexible middle section whereby said mat is foldable such that said panels are aligned into a stack defining a storage position.

5. The assembly of claim 1, further including said interior strips being constructed of rubber.

6. A jumping game assembly comprising:

a mat including a plurality of panels, each of said panels being constructed of plastic, each of said panels forming a target area configured for being jumped upon by a user, said panels being arranged into rows and columns, said rows and columns defining adjacently positioned interior edges of said panels and outer edges of said panels, said outer edges corresponding to an outer perimeter of said mat, said panels having upper and lower cutouts extending along said interior edges of said panels defining a tongue extending from a medial portion of each interior edge of said panels, said panels having top cutouts extending around said outer edges of each of said panels a plurality of interior strips coupled to and extending between said adjacently positioned interior edges of said panels, each of said interior strips being constructed of rubber, each said interior strip having a medial groove receiving said tongue of an associated one of said interior panels whereby said panels are coupled to said interior strips, each of said interior strips having a flexible middle section whereby said mat is foldable such that said panels are aligned into a stack defining a storage position, and an upper border coupled to and extending around said outer edges of said panels, said upper border being constructed of rubber, said upper border being coupled to and positioned in said top cutouts; and a disc, said disc being configured for throwing onto said mat to define a target area the person must remove said disc from prior to jumping upon.

* * * * *